US010682544B2

(12) United States Patent
Kudlak

(10) Patent No.: US 10,682,544 B2
(45) Date of Patent: Jun. 16, 2020

(54) RESISTANCE TRAINING EXERCISE DEVICE

(71) Applicant: HILATE INC., North Bay (CA)

(72) Inventor: Robert M. Kudlak, North Bay (CA)

(73) Assignee: HILATE INC., North Bay (CA)

( * ) Notice: Subject to any disclaimer, the term of this patent is extended or adjusted under 35 U.S.C. 154(b) by 59 days.

(21) Appl. No.: 15/671,475

(22) Filed: Aug. 8, 2017

(65) Prior Publication Data

US 2019/0046832 A1 Feb. 14, 2019

(51) Int. Cl.

*A63B 21/00* (2006.01)
*A63B 21/072* (2006.01)
*A63B 23/035* (2006.01)

(52) U.S. Cl.

CPC ..... *A63B 21/4017* (2015.10); *A63B 21/0724* (2013.01); *A63B 21/0728* (2013.01); *A63B 23/03516* (2013.01); *A63B 23/03525* (2013.01)

(58) Field of Classification Search

CPC ..... A63B 21/4017; A63B 21/0724; A63B 23/03525; A63B 21/0728; A63B 23/03516; A63B 21/0004; A63B 21/00058–00072; A63B 21/06; A63B 21/072–075

See application file for complete search history.

(56) References Cited

U.S. PATENT DOCUMENTS 2,617,650 A * 11/1952 Landis ..... A63B 21/072 482/108
4,109,908 A * 8/1978 Pugh ..... A63B 21/065 482/105
4,231,569 A * 11/1980 Rae ..... A63B 23/1281 482/108
4,312,506 A * 1/1982 Brennan ..... A63B 21/0724 482/106
4,327,908 A * 5/1982 James ..... A63B 21/0724 482/105
4,345,756 A * 8/1982 Hoagland ..... A63B 21/075 482/109
4,607,840 A * 8/1986 Harper ..... A63B 21/072 482/108
4,756,526 A * 7/1988 Broussard ..... A63B 21/0724 482/108
4,768,780 A * 9/1988 Hayes ..... A63B 21/0724 482/106
4,872,667 A * 10/1989 Favot ..... A63B 21/0724 482/106
5,088,725 A * 2/1992 Arnold ..... A63B 21/072 482/97

(Continued)

*Primary Examiner* — Andrew S Lo
(74) *Attorney, Agent, or Firm* — Perry + Currier

(57) ABSTRACT

The present disclosure relates to a resistance training exercise device that includes a frame; a holder coupled to the frame, the holder defining a lever channel for receiving a forearm of a user; the holder and the frame configured to rotate with the forearm about an elbow relative to an upper arm when the user is performing a rotary resistance training exercise; and a weight support for receiving one or more weights thereon, the weight support fixed to the frame and spaced apart from the holder in a direction selected to maintain, throughout the resistance exercise, an angle between the upper arm and the weight support that is greater by a constant value than an angle between the upper arm and the lever channel.

5 Claims, 18 Drawing Sheets

(56) References Cited

U.S. PATENT DOCUMENTS 5,110,119 A * 5/1992 Arnold ..... A63B 21/4017 482/108
5,540,640 A * 7/1996 Povilaitis ..... A63B 21/072 482/106
5,573,484 A * 11/1996 Carpenter ..... A63B 21/00181 482/108
D398,675 S * 9/1998 Marney ..... D21/681
D398,676 S * 9/1998 Marney ..... D21/681
5,971,339 A * 10/1999 Falasco, Jr. ..... A63B 21/4017 248/175
D425,151 S * 5/2000 Landfair ..... D21/679
6,663,542 B1 * 12/2003 Trabbic ..... A63B 21/0724 482/106
7,097,601 B1 * 8/2006 Ronnow ..... A63B 21/072 482/106
7,303,507 B1 * 12/2007 Jozsa ..... A63B 21/072 482/109
8,574,136 B1 * 11/2013 Burstrom ..... A63B 69/0057 482/108
9,254,410 B1 * 2/2016 Mirza ..... A63B 21/0004
2002/0119872 A1 * 8/2002 Greenheck ..... A63B 21/072 482/93
2002/0190177 A1 * 12/2002 Nielsen ..... A63B 21/4035 248/339
2006/0040802 A1 * 2/2006 Vittone ..... A63B 21/0724 482/106
2006/0105890 A1 * 5/2006 Logue ..... A63B 21/0724 482/106
2006/0116256 A1 * 6/2006 Carney ..... A63B 21/0724 482/106
2007/0287600 A1 * 12/2007 Prenatt ..... A63B 21/0603 482/41
2008/0026920 A1 * 1/2008 Berenshteyn ..... A63B 21/0724 482/106
2010/0144501 A1 * 6/2010 Berhanu ..... A63B 21/072 482/139
2013/0190145 A1 * 7/2013 Kugielsky ..... A63B 21/00058 482/110
2014/0087925 A1 * 3/2014 Dupuis ..... A63B 21/062 482/97
2014/0094347 A1 * 4/2014 Orakwusi ..... A63B 21/1636 482/38
2014/0287889 A1 * 9/2014 Grace ..... A63B 21/0728 482/106
2016/0144219 A1 * 5/2016 Koenig ..... A63B 21/075 482/93
2019/0022451 A1 * 1/2019 Koenig ..... A63B 21/075

* cited by examiner

RESISTANCE TRAINING EXERCISE DEVICE

FIELD

The present disclosure relates to resistance training, and more particularly, to resistance training exercise devices.

BACKGROUND

Resistance training devices such as barbells and dumbbells are used for performing resistance training exercises such as biceps curls and triceps curls. However, conventional resistance training devices may apply resistance in an inefficient manner, reducing the benefits of the exercises. Such devices may also expose their users to undesirably high risks of injury.

SUMMARY

An aspect of the specification provides a resistance training exercise device comprising: a frame; a holder coupled to the frame, the holder defining a lever channel for receiving a forearm of a user; the holder and the frame configured to rotate with the forearm about an elbow of the user relative to an upper arm of the user when the user is performing a rotary resistance training exercise; and a weight support fixed to the frame and spaced apart at a distance from the holder in a direction selected to maintain, throughout the resistance exercise, an angle between the upper arm and the weight support that is greater by a constant value than an angle between the upper arm and the lever channel.

BRIEF DESCRIPTIONS OF THE DRAWINGS

Embodiments are described with reference to the following figures, in which:

Embodiments of the present disclosure will be described, by way of example, with reference to the drawings and to the following description, in which.

DETAILED DESCRIPTION

Figure 1:
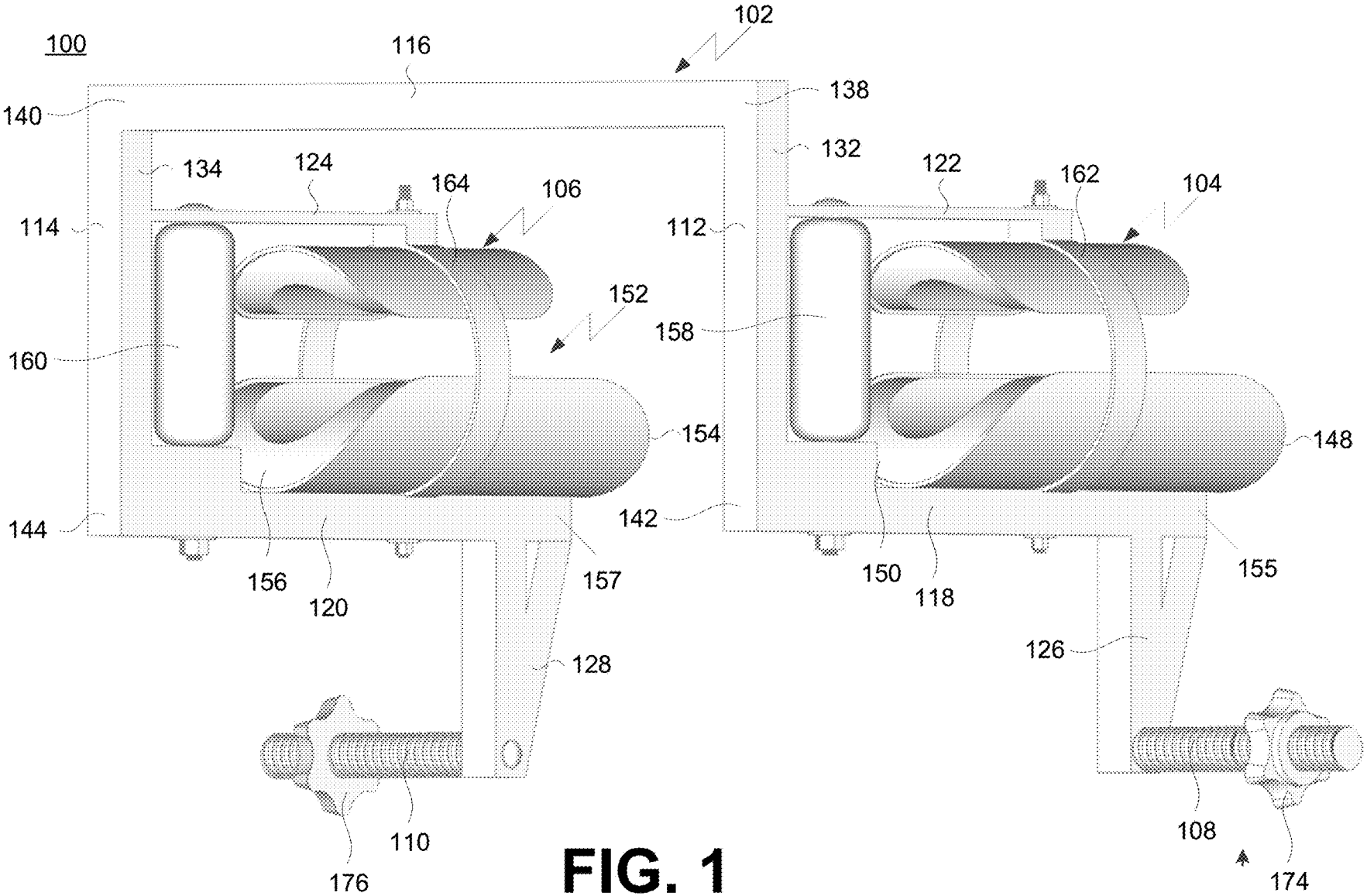
FIG. 1 is a front perspective view of a resistance training exercise device for performing a rotary exercise in accordance with an embodiment.
Figure 2:
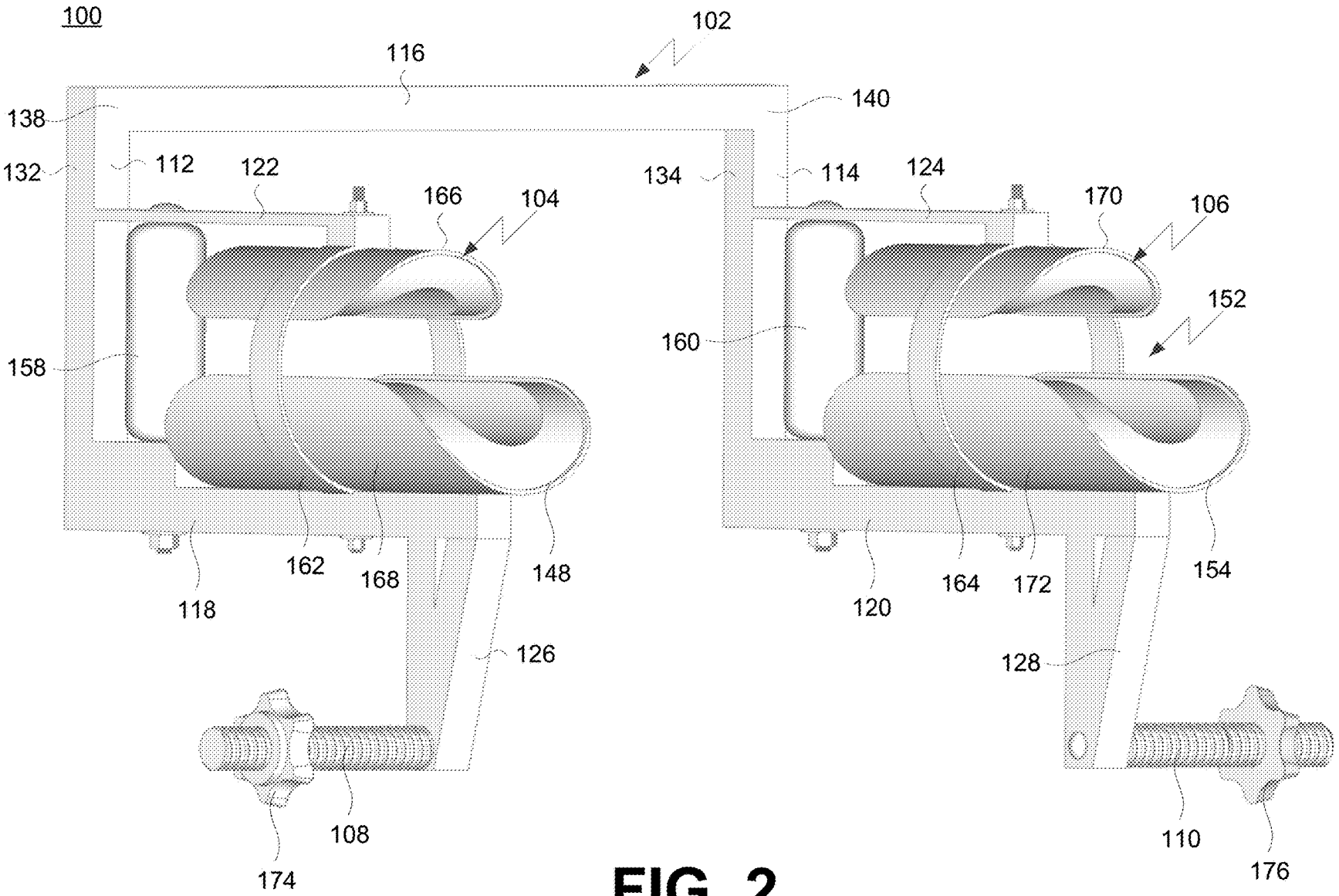
FIG. 2 is a rear perspective view of a resistance training exercise device of FIG. 1.

For simplicity and clarity of illustration, reference numerals may be repeated among the figures to indicate corresponding or analogous elements. Numerous details are set forth to provide an understanding of the embodiments described herein. The embodiments may be practiced without these details. In other instances, well-known methods, procedures, and components have not been described in detail to avoid obscuring the embodiments described.

Barbells and dumbbells typically provide a straight bar having an axis extending along the straight bar. The ends of the support bar support weights, e.g. in the form of one or more plates. The support bar is held by the user and revolved about a joint, such as the elbow in the case of a biceps or triceps exercise.

Due to the positioning of the weights on a typical barbell, when a user uses a conventional barbell to perform a biceps exercise, the greatest resistance is exerted by the weights is when the biceps are fully extended (e.g. when the user's forearms are parallel to the ground and the upper arms are about 180 degrees from the forearms). When the biceps are fully extended, the biceps are not contracted and the user's joints (e.g. wrists and elbows) may be at the greatest risk of injury. Further, as the user nears a position in which and the biceps are in full contraction, the forearms of the user approach a vertical orientation, and therefore little or no appreciable muscular strength is needed to hold the barbell up as the barbell is being supported primarily by the user's bones and joints. The biceps therefore perform little work as the user approaches the contracted position, reducing the efficacy of the exercise. In other words, a resistance provided by the conventional barbell is out of phase with the needs of the underlying muscles and joints (e.g. resistance is high when injury risk is also high and reduced load would be beneficial, while resistance is low when injury risk is reduced and greater load would be beneficial).

Further, the hands and wrists of the user are subjected to substantial loads during exercises with conventional devices. The muscles of the hands and wrists generally fatigue before the bicep or triceps muscles, which may lead to early cessation of the exercise, injury of the hands or wrists, or both.

The disclosure generally relates to a resistance training exercise device for performing a rotary resistance training exercise, such as, for example, a biceps curl or a triceps curl that substantially synchronizes the application of greater resistance to the biceps or triceps with the full contraction of the biceps or triceps, and the application of lower resistance with the full extension of the biceps or triceps. The resistance training devices described herein may therefore reduce a risk of injury during rotary resistance training exercises, and may increase the effectiveness of such exercises.

Attention is directed to FIG. 1 to FIG. 8, which show an example embodiment of a resistance training exercise device 100 for performing a rotary resistance training exercise such as a triceps curl. The resistance training exercise device 100 (referred to hereinafter as exercise device 100) includes a frame 102, a first holder 104 coupled to the frame 102, and a second holder 106 coupled to the frame 102 as described in further detail below. The exercise device 100 also includes a first weight support 108 fixed to the frame 102 and spaced apart from the first holder 104, and a second weight support 110 fixed to the frame 102 and spaced apart from the second holder 106 as described in further detail below.

Figure 3:
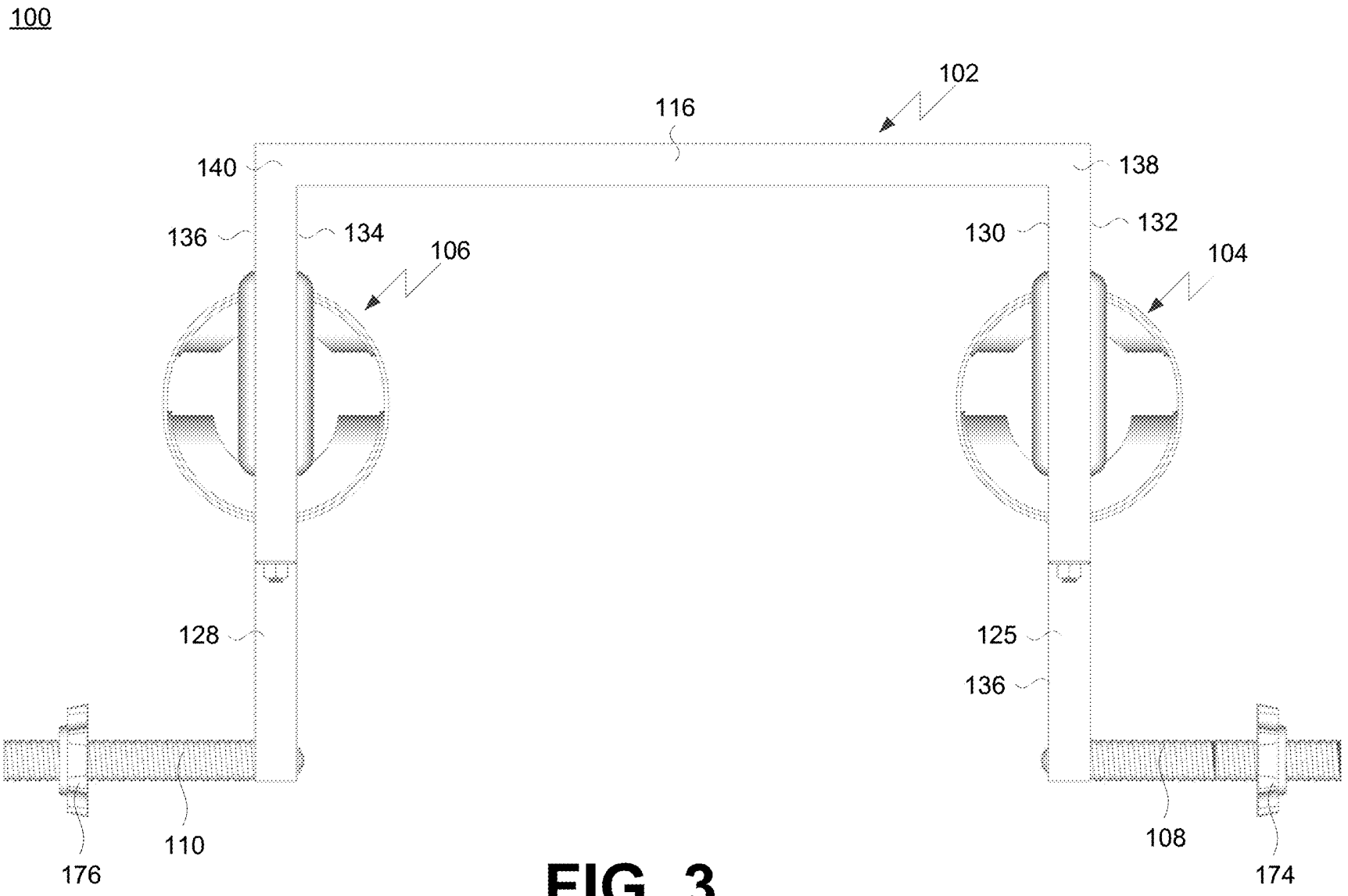
FIG. 3 is a front view of the resistance training exercise device of FIG. 1.
Figure 4:
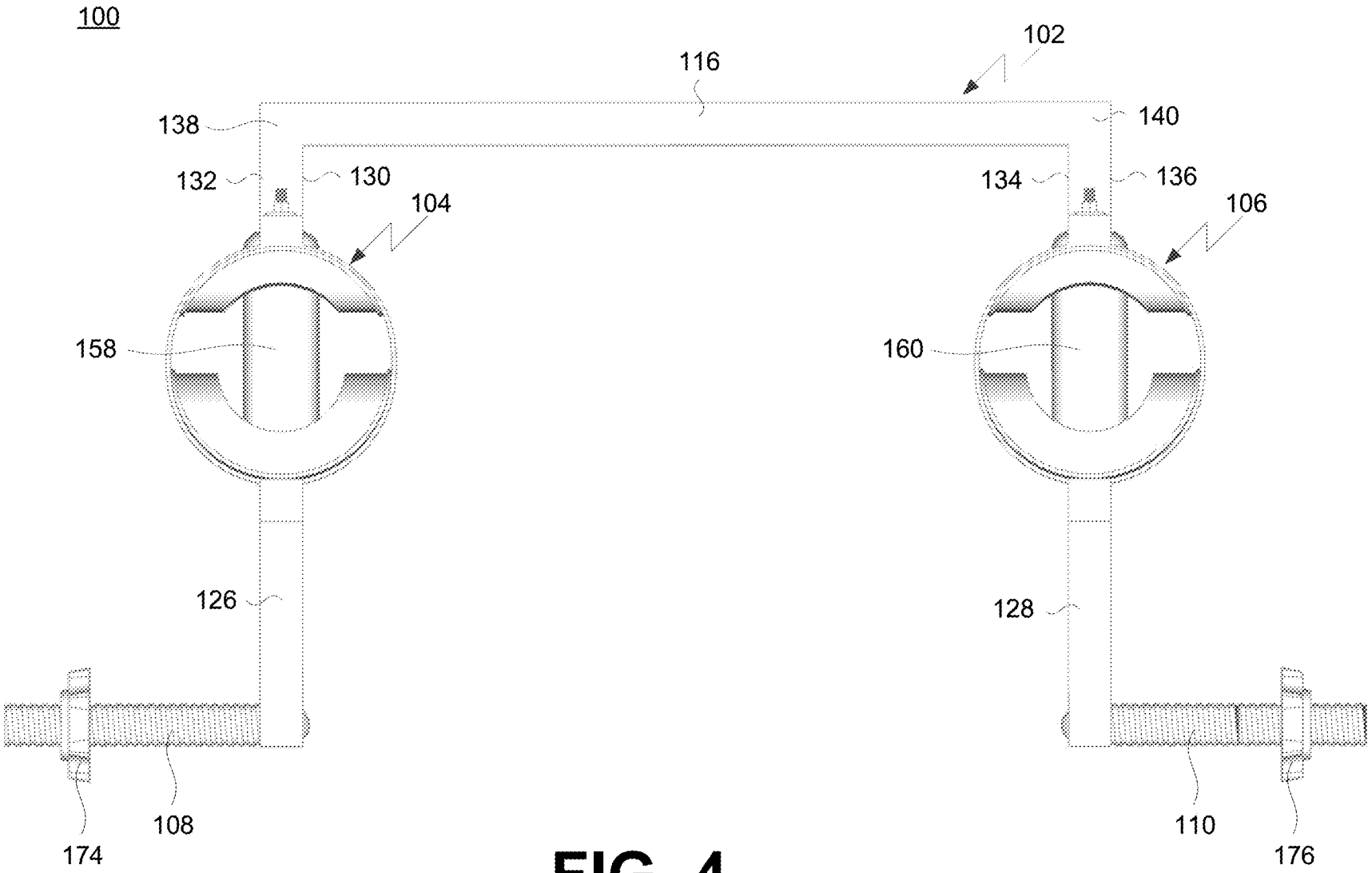
FIG. 4 is a rear view of the resistance training exercise device of FIG. 1.
Figure 5:
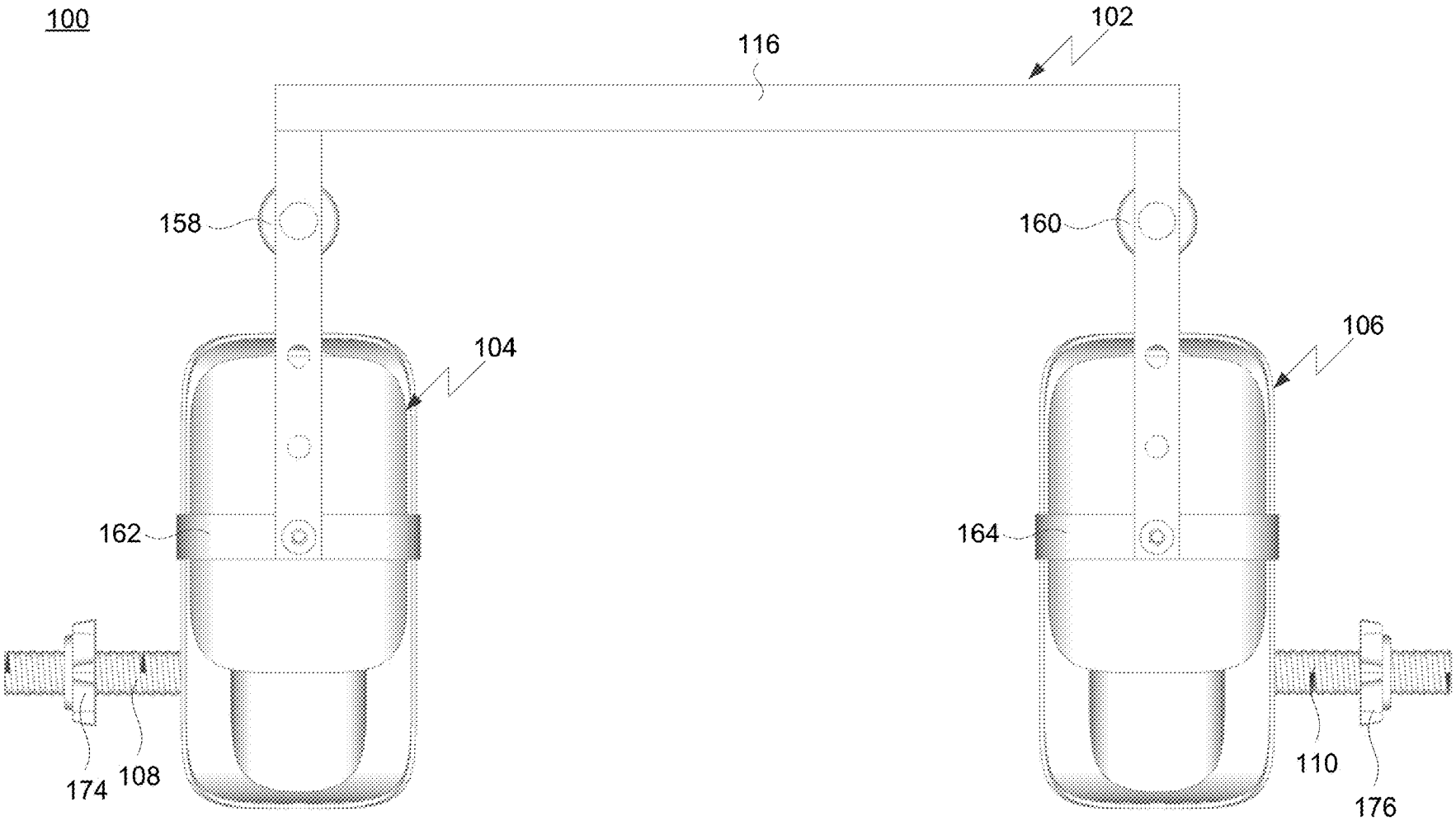
FIG. 5 is a top view of the resistance training exercise device of FIG. 1.
Figure 6:
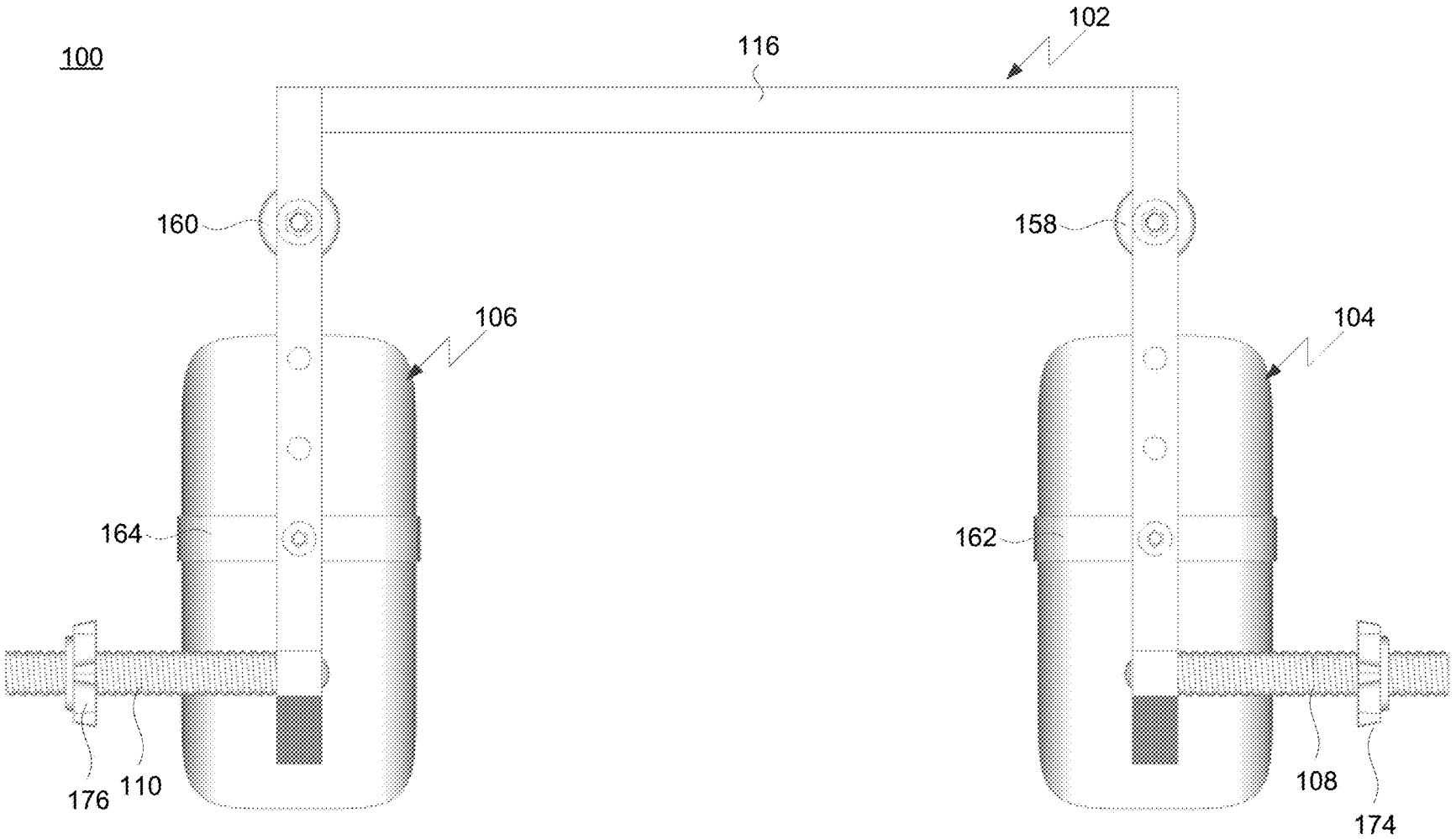
FIG. 6 is a bottom view of the resistance training exercise device of FIG. 1.

The frame 102 includes a first side member 112, a second side member 114, a cross bar 116, a first holder support 118, a second holder support 120, a first arm 122, a second arm 124, a first hanger 126, and a second hanger 128. The first side member 112 of the frame 102 has an inner surface 130 (FIGS. 3-4) and an outer surface 132 (FIG. 1). Similarly, the second side member 114 of the frame 102 has an inner surface 134 (FIG. 1) and an outer surface 136 (FIGS. 3-4). The first side member 112 and the second side member 114 are substantially parallel to each other and spaced apart such that the inner surface 130 of the first side member 112 opposes the inner surface 134 of the second side member 114. The cross bar 116 of the frame 102 is coupled to the first side member 112 at a top end 138 of the first side member 112 and coupled to the second side member 114 at a top end 140 of the second side member 114. The cross bar 116 extends between the first side member 112 and the second side member 114.

Although the first side member 112 and the second side member 114 are substantially parallel to each other in the embodiment shown in FIG. 1 to FIG. 8, in alternative embodiments, the first side member 112 and the second side member 114 are spaced apart from each other and can be angled towards each other or away from each other.

The first holder support 118 of the frame 102 is coupled to the first side member 112 at a bottom end 142 of the first side member 112. The first holder support 118 supports the first holder 104. Similarly, the second holder support 120 of the frame 102 is coupled to the second side member 114 at the bottom end 144 of the second side member 114. The second holder support 120 supports the second holder 106. In the embodiment shown in FIG. 1 to FIG. 8, the first holder support 118 extends away from the first side member 112 and is substantially perpendicular to the first side member 112, and the second holder support 120 extends away from the second side member 114 and is substantially perpendicular to the second side member 114. Also, the second holder support 120 is substantially parallel with the first holder support 118.

The first and second side members 112 and 114, the first and second holder supports 118 and 120, and the cross bar 116 are arranged to provide sufficient space for a body of a user to fit between the first side member 112 and the second side member 114 during the performance of a triceps curl exercise, as will be discussed below in greater detail. It will be appreciated that in alternative embodiments, other arrangements of the first and second side members 112 and 114, the first and second holder supports 118 and 120, and the cross bar 116 also satisfy the above-mentioned provision of space. For example, the cross bar 116 can be coupled to the first side member 112 at any suitable position between the top end 138 and the bottom end 142. Further, the first holder support 118 and the second holder support 120 can be angled towards or away from each other. Moreover, although the first holder support 118 is substantially perpendicular to the first side member 112 in the embodiment in FIG. 1 to FIG. 8, in alternative embodiments, the first holder support 118 may connected to the first side member 112 at non-right angles. Also, in alternative embodiments, the second holder support 120 may be connected to the second side member 114 at non-right angles.

The first arm 122 of the frame 102 is coupled to the first side member 112 between the top end 138 of the first side member 112 and a top of the first holder 104. The first arm 122 extends away from the first side member 112 such that the first arm 122 is substantially parallel to the first holder support 118. Similarly, the second arm 124 of the frame 102 is coupled to the second side member 114 between the top end 140 of the second side member 114. The second arm 124 also extends away from the second side member 114 such that the second arm 124 is substantially perpendicular to the second side member 114 and substantially parallel with the first arm 122.

Figure 7:
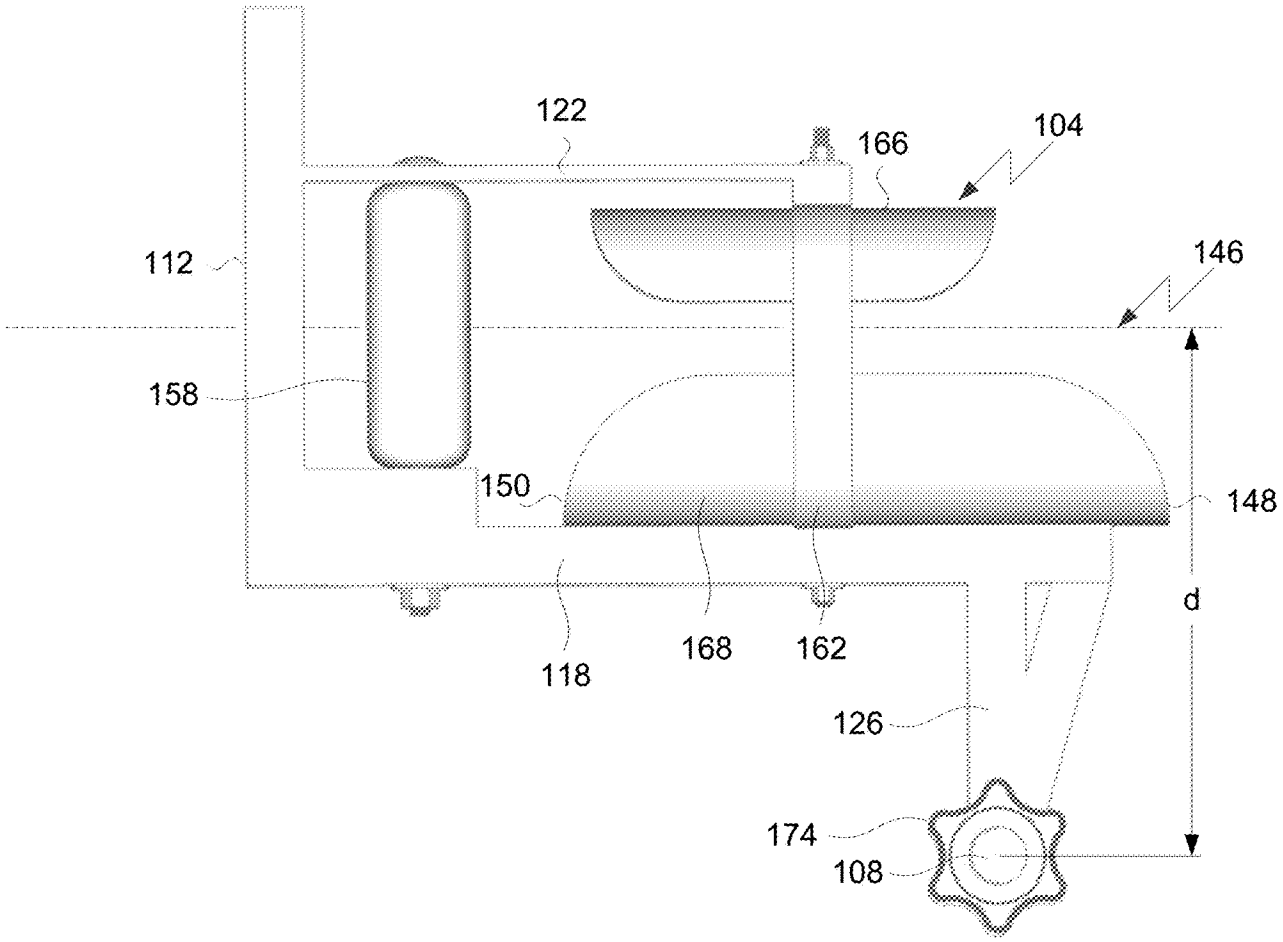
FIG. 7 is a left side view of the resistance training exercise device of FIG. 1.

The first holder 104 is positioned between the first holder support 118 and the first arm 122 and defines a first lever channel axis 146 (FIG. 7). The first holder 104 is disposed on the first holder support 118 and affixed thereto by a fastener as described in further detail below. The first holder 104 has a first end 148 for receiving the left forearm of a user of the exercise device 100, and a second end 150 opposing the first end 148.

Figure 8:
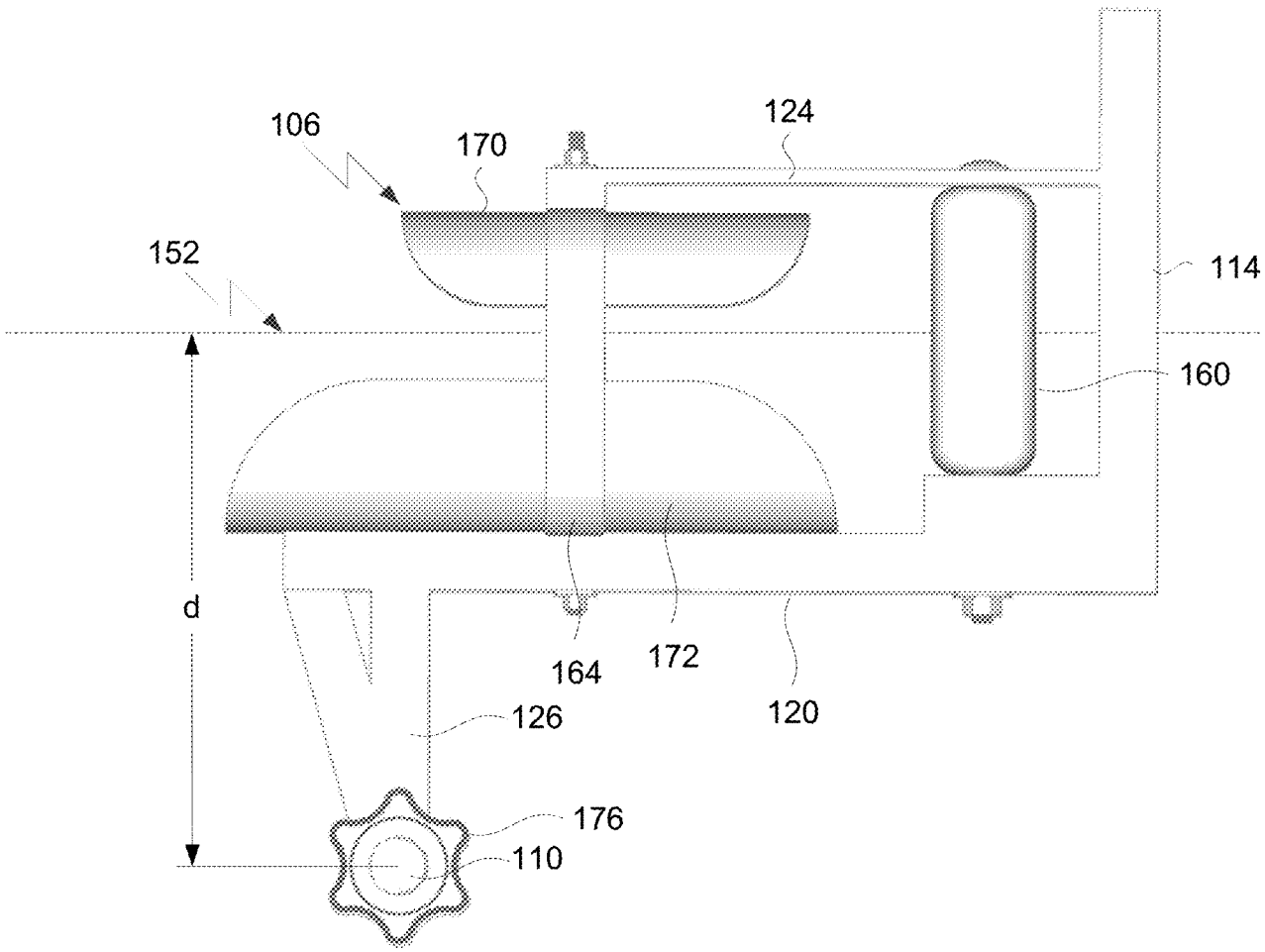
FIG. 8 is a right side view of the resistance training exercise device of FIG. 1.

The second holder 106 is positioned between the second holder support 120 and the second arm 124 and defines a second lever channel axis 152 (FIG. 8). The second holder 106 has a first end 154 for receiving the right forearm of the user of the exercise device 100, and a second end 156 opposing the first end 154.

The first hanger 126 of the frame 102 is coupled to the first holder support 118 proximate a first end 155 of the first holder support 118. The first hanger 126 extends from the first holder support 118 in a direction away from the first lever channel axis 146. The first weight support 108 is fixed to first hanger 126 such that the first weight support 108 is spaced apart from the first holder support 118, and thus from the first lever channel axis 146. The first weight support 108 extends from the first hanger 126 in a direction away from the space defined between the first side member 112 and the second side member 114. The first weight support 108 is configured to receive one or more weights thereon.

Similarly, the second hanger 128 of the frame 102 is coupled to the second holder support 120 proximate a first end 157 of the second holder support 120. The second hanger 128 extends from the second holder support 120 in a direction away from the second lever channel axis 152. The second weight support 110 is fixed to the second hanger 128 such that the second weight support 110 is spaced apart from the second holder support 120. The second weight support 110 extends from the second hanger 128 in a direction away from the space defined between the first and second side members 112 and 114. The second weight support 110 is configured to receive one or more weights thereon.

In the embodiment shown in FIG. 1 to FIG. 8, the first hanger 126 is substantially perpendicular to the first holder support 118 and spaced apart from the first lever channel axis 146 by a distance d, measured perpendicularly to the first lever channel axis 146 (see FIG. 7) and the second hanger 128 is perpendicular to the second holder support 120 and spaced apart from the second lever channel axis 152 by the same distance d, measured perpendicularly to the second lever channel axis 152 (see FIG. 8). In alternative embodiments, the first hanger 126 can extend at a non-right angle from the first end 155 of the first holder support 118. Similarly, the second hanger 128 can extend at a non-right angle from the first end 157 of the second holder support 120. Also, in the embodiment of FIG. 1 to FIG. 8, the first weight support 108 is substantially perpendicular to the first hanger 126 to inhibit one or more weights from sliding off the first weight support 108 when placed on the first weight support 108. Similarly, the second weight support 110 is substantially perpendicular to the second hanger 128 to inhibit one or more weights from sliding off the second weight support 110 when placed on the second weight support 110. However, in alternative embodiments, the first weight support 108 can be angled towards or away from the first holder support 118, and the second weight support 110 can be angled towards or away from the second holder support 120.

Referring again to FIG. 1 to FIG. 8, the exercise device 100 also includes a first handle 158 for gripping by the left hand of the user when the left forearm of the user is positioned within the first holder 104, and a second handle 160 for gripping by the right hand of the user when the right forearm of the user is positioned within the second holder 106. The first handle 158 is disposed between the first side member 112 and the second end 150 of the first holder 104. The first handle 158 is spaced from the first side member 112 of the frame 102 to enable gripping of the first handle 158 by the left hand of a user. The first handle 158 extends between and is affixed to the first holder support 118 and the first arm 122.

The second handle 160 is disposed between the second side member 114 and the second end 156 of the second holder 106. The second handle 160 is spaced from the second side member 114 of the frame 102 to enable gripping of the second handle 160 by the right hand of a user. The second handle 160 extends between and is affixed to the second holder support 120 and the second arm 124.

Although the exercise device 100 shown in FIG. 1 to FIG. 8 includes the first handle 158 and the second handle 160, in alternative embodiments, the first handle 158 and the second handle 160 may be omitted from the exercise device 100, the first side member 112 may form the first handle for gripping by the left hand of the user, and the second side member 114 may form the second handle for gripping by the right hand of the user.

In the embodiment shown in FIG. 1 to FIG. 8, a first bracket 162 surrounds the first holder 104 and a second bracket 164 surrounds the second holder 106. The first bracket 162 is affixed to the first holder support 118 and to the first arm 122 by fasteners, such as for example, a bolt and a nut. The second bracket 164 is affixed to the second holder support 120 and to the second arm 124 by fasteners, such as for example, a bolt and a nut.

Also, in the embodiment shown in FIG. 1 to FIG. 8, the first holder 104 includes two separate parts, an upper forearm support 166 and a lower forearm support 168. The upper forearm support 166 may include padding for cushioning a lateral side (i.e. the side defined by the radius) of the left forearm of the user, and the lower forearm support 168 may include padding for cushioning a medial side (i.e. the side defined by the ulna) of the left forearm of the user. It will be appreciated that in other alternative embodiments, the padding may be omitted from the upper forearm support 166 and/or lower forearm support 168 of the first holder 104.

The second holder 106 also includes two separate parts, an upper forearm support 170 and a lower forearm support 172. The upper forearm support 170 may include padding for cushioning a lateral side (i.e. the side defined by the radius) of the right forearm of the user, and the lower forearm support 172 may include padding for cushioning a medial side (i.e. the side defined by the ulna) of the right forearm of the user. It will be appreciated that in other alternative embodiments, the padding may be omitted from the upper forearm support 170 and/or lower forearm support 172 of the second holder 106.

Although in the embodiment shown in FIG. 1 to FIG. 8, the first holder 104 and the second holder 106 each include two separate parts, in alternative embodiments, the first holder 104 may be a single part shaped and dimensioned to receive, surround, and retain the left forearm of the user therein. Also, in other alternative embodiments, the second holder 106 may be a single part shaped and dimensioned to receive and surround the right forearm of the user therein.

Also, in the embodiment shown in FIG. 1 to FIG. 8, both the first weight support 108 and the second weight support 110 are threaded. The exercise device 100 includes a first collar 174 for securing one or more weights to the first weight support 108 and for inhibiting the one or more weights from falling off the first weight support 108. The exercise device 100 also includes a second collar 176 for securing one or more weights to the second weight support 110 and for inhibiting the one or more weights from falling off the second weight support 110. It will be appreciated that in alternative embodiments, the first weight support 108 and/or the second weight support 110 may not be threaded. In these alternative embodiments, any suitable clamp, collar, or lock jaw may be used to secure one or weights onto the first weight support 108 and/or the second weight support 110 and to inhibit the one or more weights from sliding or falling off the first weight support 108 and/or the second weight support 110.

It will also be appreciated that in other alternative embodiments, one or both of the first weight support 108 and the second weight support 110 may extend from their respective first and second hangers 126, 128 into the space between the first and second side members 112 and 114.

The operation of exercise device 100 will now be described with reference to FIGS. 9A, 9B, and 9C which show the exercise device 100, from the left side of the user, being used to perform a triceps curl. The exercise device 100 is shown positioned for use, with the left forearm of the user extending through the channel defined by the first holder 104 and the user's left hand gripping the first handle 158. Further, a weight 900 is supported by the first weight support 108 and maintained on the first weight support 108 by the first collar 174. As will be apparent, the forearms of the user rotate about the elbows of the user, primarily through the action of the biceps and triceps. The left elbow of the user is indicated as a pivot point 904, through which the first lever channel axis 146 passes.

Figure 9A:
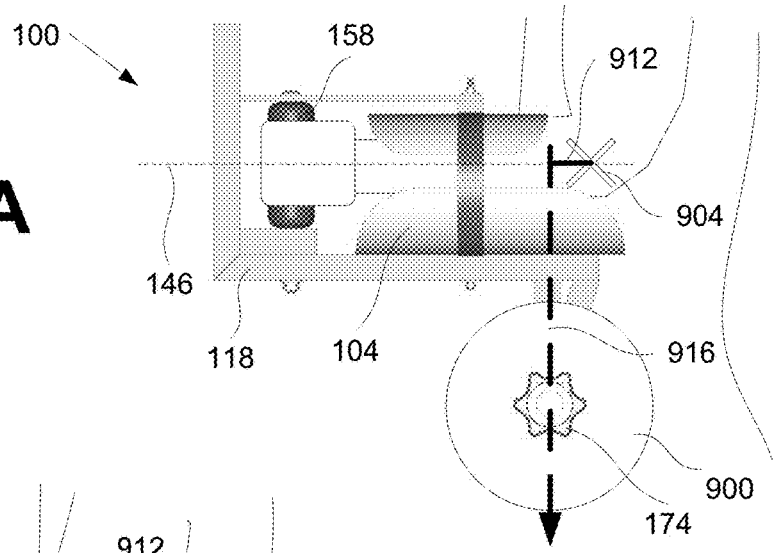
FIGS. 9A-9C are side views of the resistance training exercise device of FIG. 1 travelling from an extended position to a contracted position during use.
Figure 9B:
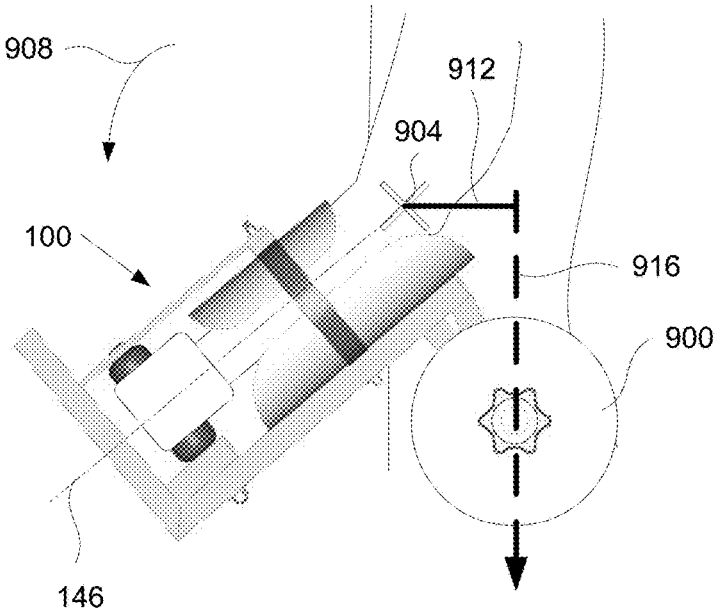
Figure 9C:
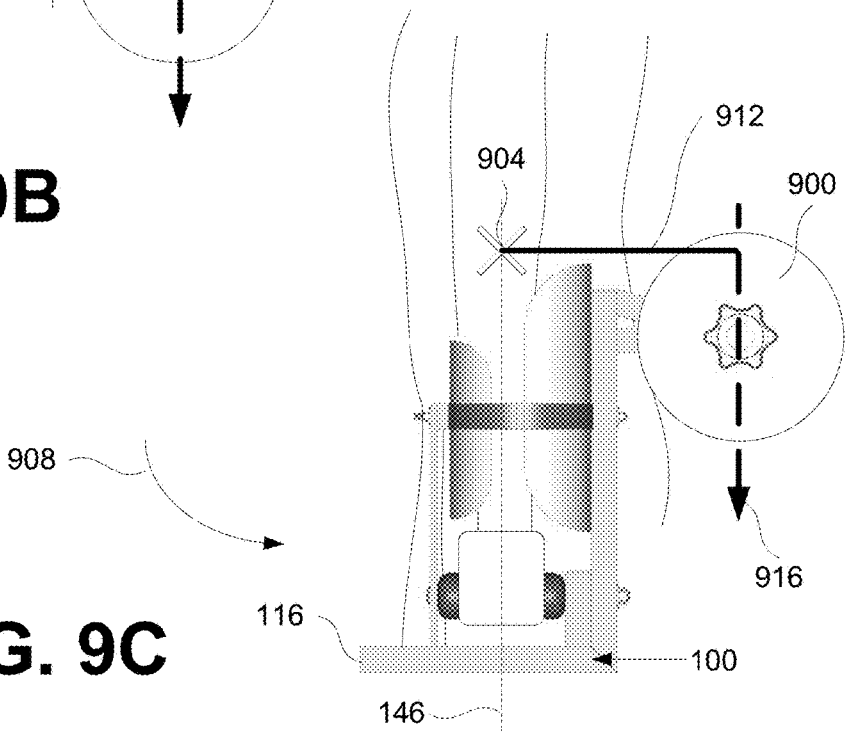
Figure 10:
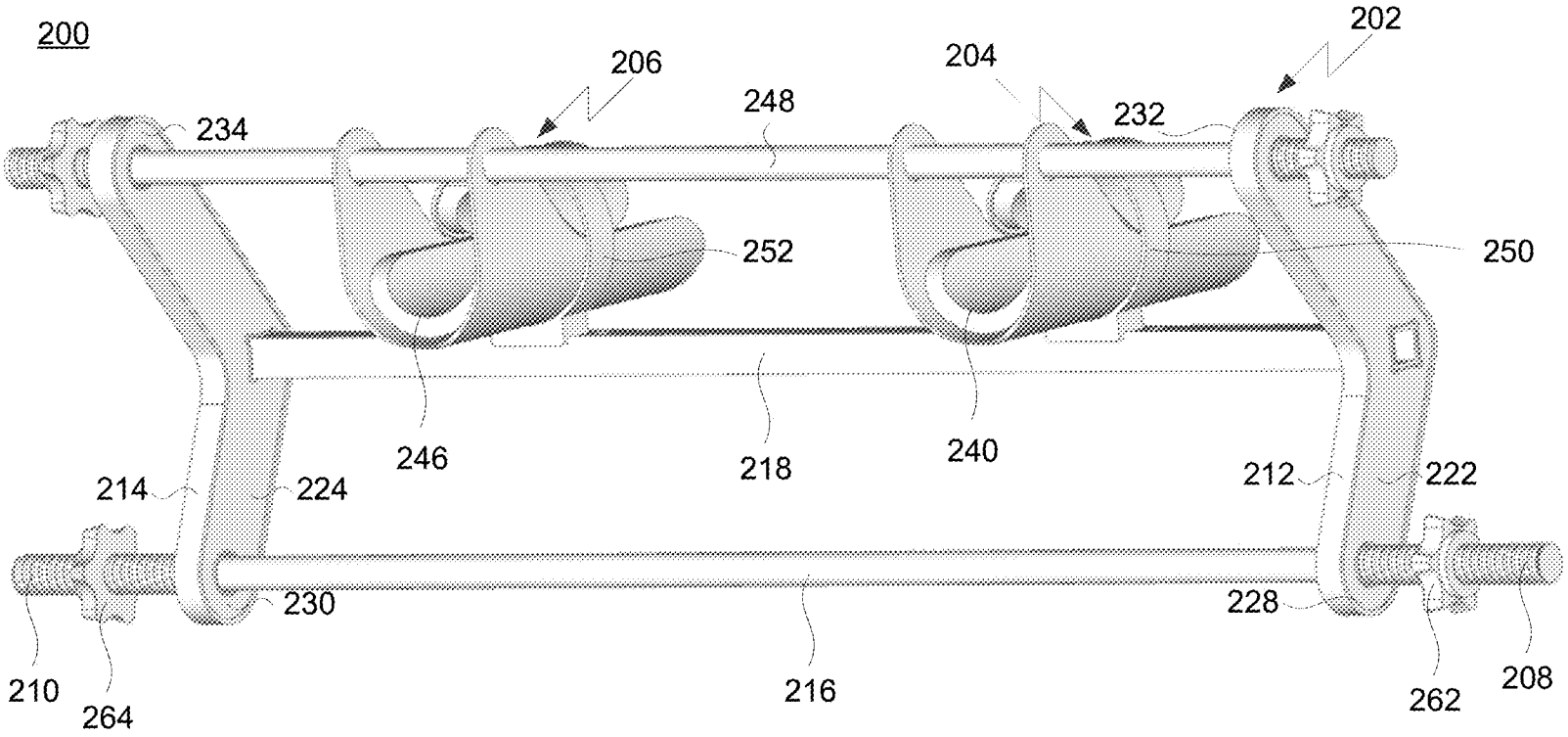
FIG. 10 is a front perspective view of a resistance training exercise device for performing a rotary exercise in accordance with another embodiment.
Figure 11:
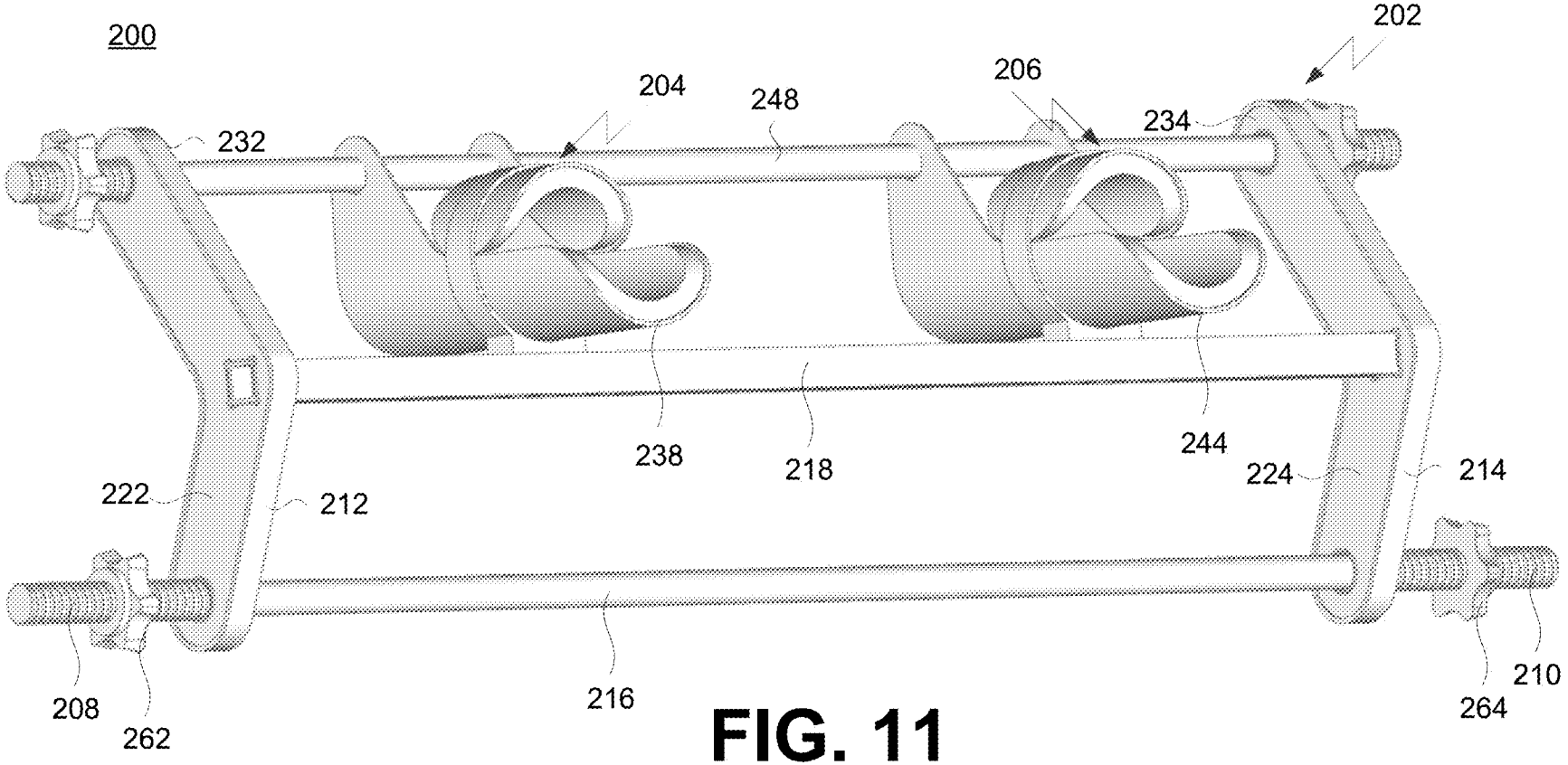
FIG. 11 is a rear perspective view of a resistance training exercise device of FIG. 7.
Figure 12:
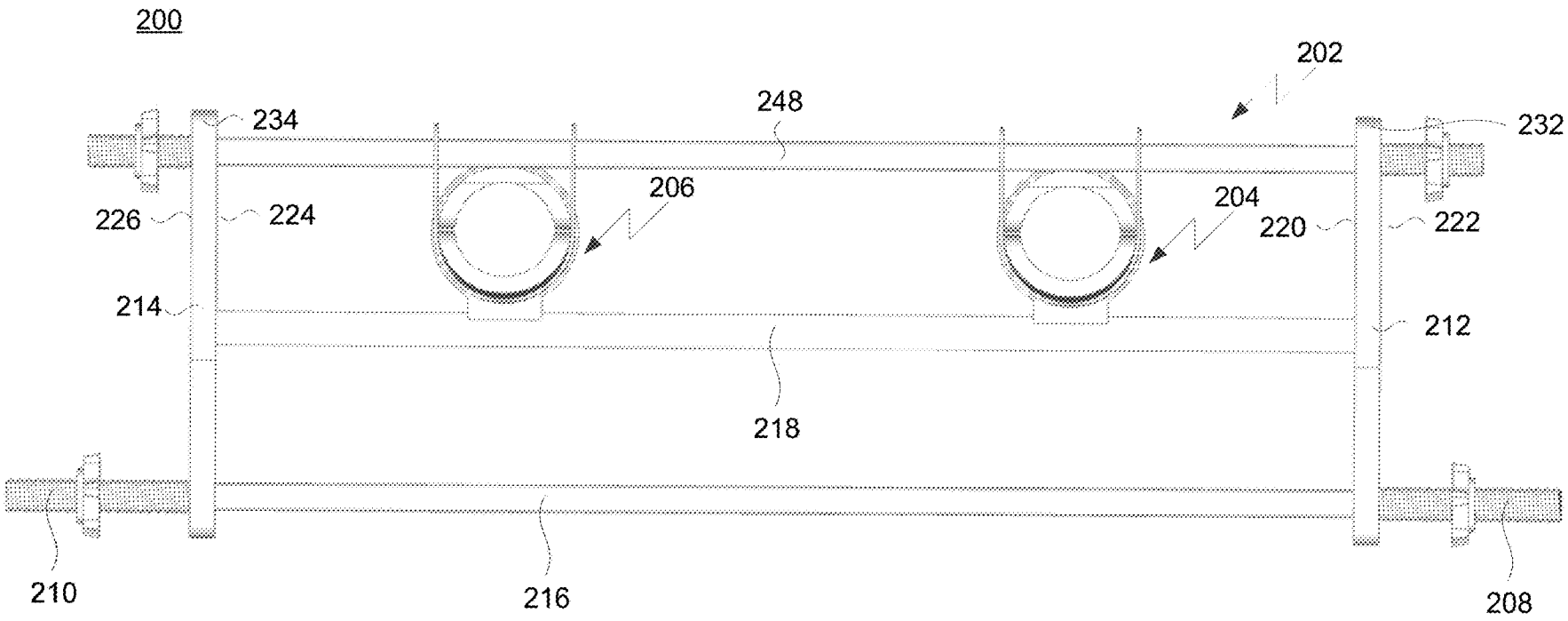
FIG. 12 is a front view of the resistance training exercise device of FIG. 10.
Figure 13:
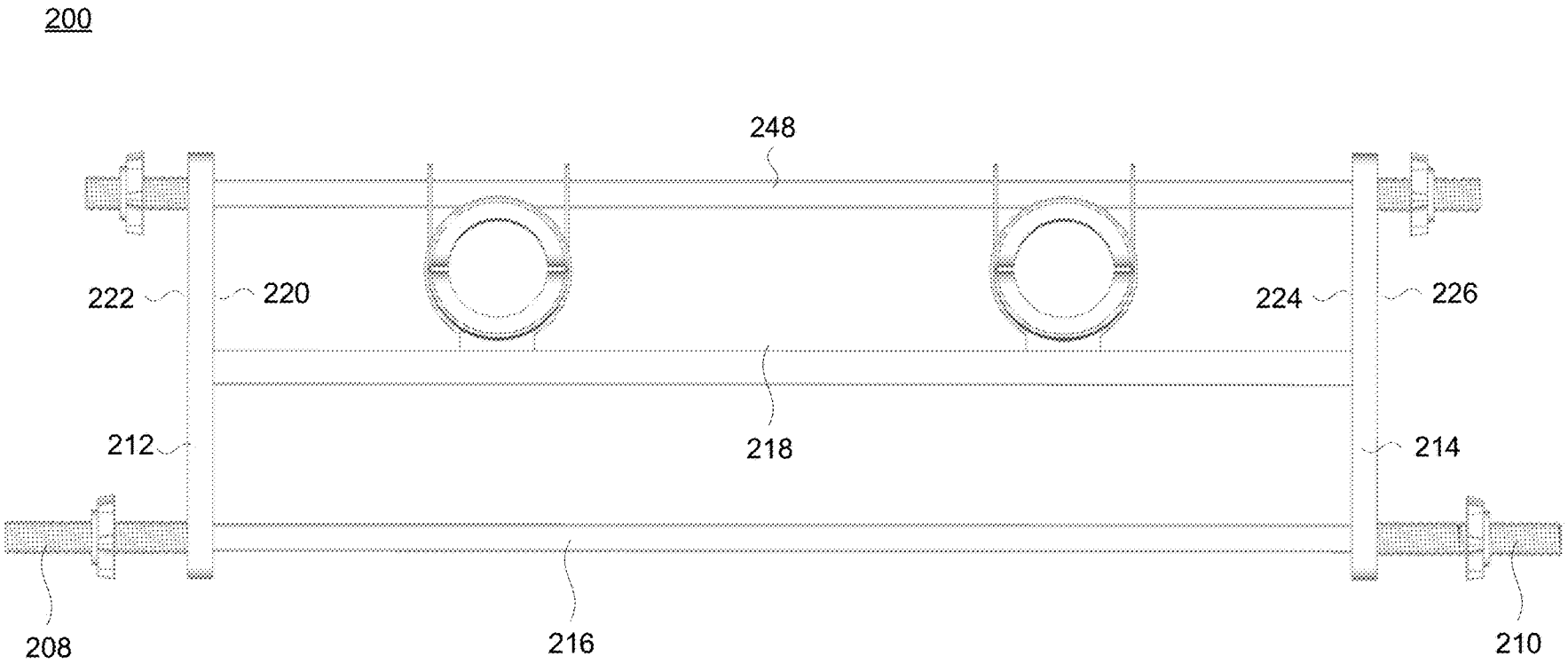
FIG. 13 is a rear view of the resistance training exercise device of FIG. 10.
Figure 14:
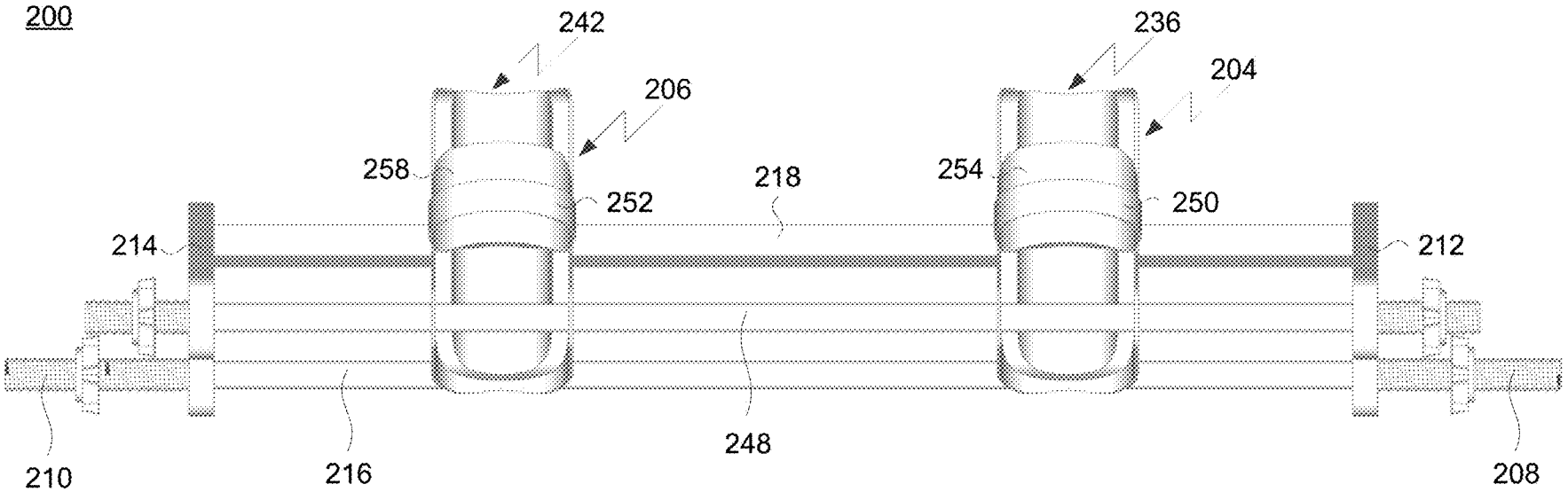
FIG. 14 is a top view of the resistance training exercise device of FIG. 10.

The triceps curl performed with the exercise device 100 requires the user to contract the triceps to rotate the exercise device 100 in the direction indicated at 908 (counterclockwise, in the illustration of FIGS. 9A to 9C), from an extended position shown in FIG. 9A to a contracted position shown in FIG. 9C. The extended position is referred to as extended because in FIG. 9A, the muscles under load (the triceps, in this example) are substantially fully extended. Conversely, the contracted position is referred to as contracted because in FIG. 9C, the muscles under load are substantially fully contracted. As shown in FIG. 9C, in the contracted position, the space defined between the cross bar 116 and the first and second side members 112 and 114 servers to accommodate the body of the user (specifically, the waist and/or thighs of the user).

As will now be apparent, the load imposed on the triceps by the weight 900 varies with the length of a moment arm 912 measured perpendicularly to the vertical (i.e. toward the earth) line of action 916 of the weight 900 to the pivot point 904. As seen in FIGS. 9A-9C, due to the spacing of the weight 900 relative to the first lever channel axis 146 by the first hanger 126, the moment arm 912 is at a minimum in the extended position (indeed, as illustrated in FIG. 9A, the weight 900 actually assists the triceps in rotating the exercise device 100 in the direction 908). Further the moment arm 912 grows through the exercise, reaching a maximum as the triceps reach full contraction in FIG. 9C.

Certain structural features of the exercise device 100 permit the above-mentioned synchronization of increasing load with increasing contraction of the muscle. In particular, as shown in FIGS. 9A-9C, the positioning of the first weight support 108 relative to the first lever channel axis 146 by way of the first hanger 126 places the first weight support 108 at a greater angle relative to the upper arm 920 (measured from the bicep side of the upper arm 920) of the user than the first lever channel axis 146. In FIG. 9A, for example, the above-mentioned angle between the upper arm 920 and the first lever channel axis 146 is about 90 degrees, whereas the angle between the upper arm 920 and the first weight support 108 is about 170 degrees. Turning to FIG. 9B, the angle between the upper arm 920 and the first lever channel axis 146 is about 150 degrees, while the angle between the upper arm 920 and the first weight support 108 is about 230 degrees. Finally, in FIG. 9C the angle between the upper arm 920 and the first lever channel axis 146 is about 180 degrees, while the angle between the upper arm 920 and the first weight support 108 is about 260 degrees. As will also be apparent, the difference between the above-mentioned angles remains constant throughout the range of exercise the exercise device 100 (a difference of about 80 degrees, in the illustrated examples). For the triceps curl illustrated in FIGS. 9A-9C, the structure of the exercise device 100 causes the weight 900 to lead the forearm of the user through the contraction of the triceps.

The synchronization between increasing load and increasing contraction noted above may reduce the likelihood of injury during the exercise, and may also increase the effectiveness of the exercise.

Attention is now directed to FIG. 10 to FIG. 17, which show another example embodiment of a resistance training device according to the present disclosure. The resistance training exercise device 200 (referred to hereinafter as exercise device 200) includes a frame 202, a first holder 204 coupled to the frame 202, and a second holder 206 coupled to the frame 202 as described in further detail below. The exercise device 200 also includes a first weight support 208 coupled to and spaced apart from the first holder 204, and a second weight support 210 coupled to and spaced apart from the second holder 206 as described in further detail below.

The frame 202 includes a first side member 212, a second side member 214, a cross bar 216, and a holder support 218. The first side member 212 has an inner surface 220 (see FIGS. 12-13) and an outer surface 222. Similarly, the second side member 214 has an inner surface 224 and an outer surface 226 (see FIGS. 12-13). The first side member 212 and the second side member 214 are substantially parallel to each other and spaced apart such that the inner surface 220 of the first side member 212 opposes the inner surface 224 of the second side member 214. The cross bar 216 of the frame 202 is coupled to the first side member 212 at a bottom end 228 of the first side member 212 and coupled to the second side member 214 at a bottom end 230 of the second side member 214.

The holder support 218 is coupled to the first side member 212 between a top end 232 of the first side member 212 and the bottom end 228 of the first side member 212. The holder support 218 is also coupled to the second side member 214 between a top end 234 of the second side member 214 and the bottom end 230 of the second side member 214.

Figure 16:
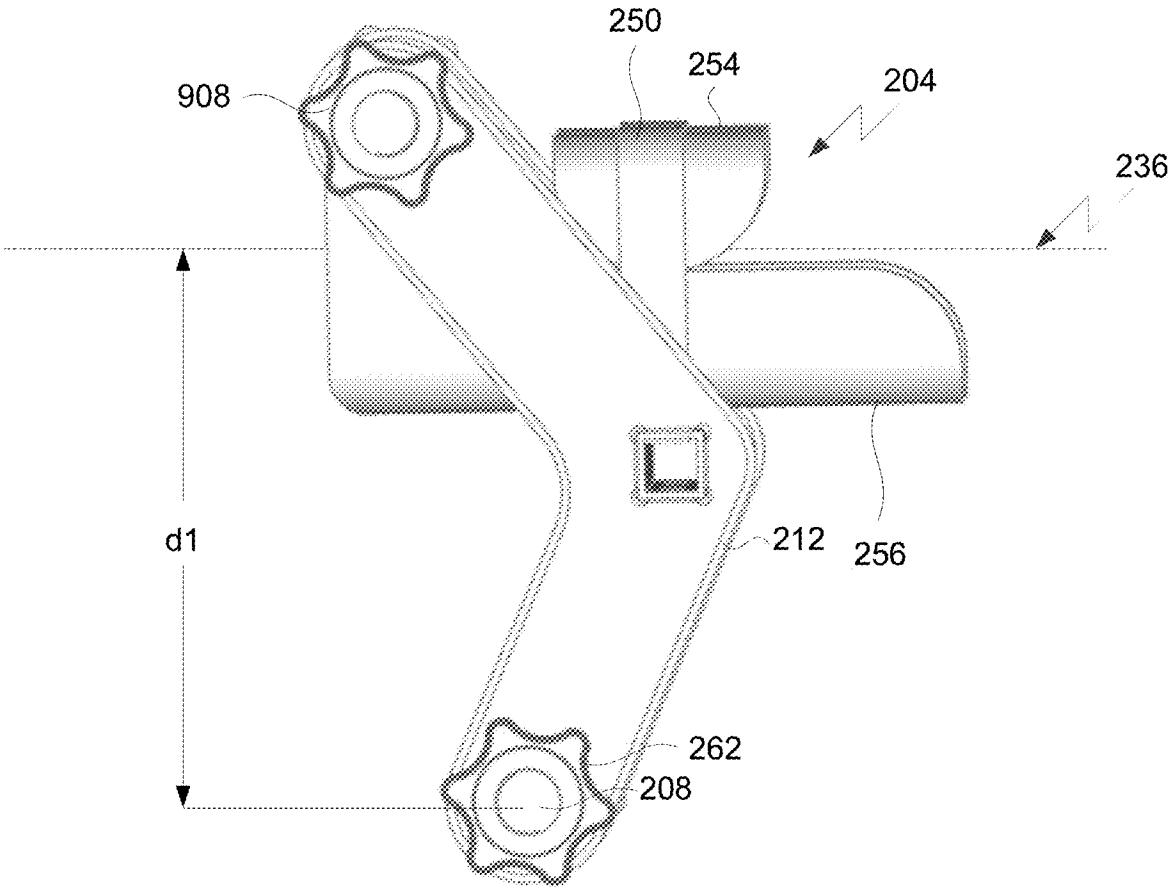
FIG. 16 is a left side view of the resistance training exercise device of FIG. 10.

The first holder 204 is disposed on the holder support 218 proximate the first side member 212 and defines a first lever channel axis 236 (FIG. 16). The first holder 204 has a first end 238 (FIG. 11) for receiving a left forearm of a user of the exercise device 200, and a second end 240 (FIG. 10) opposing the first end 238. The first holder 204 is shaped and dimensioned to surround the left forearm of the user.

Figure 17:
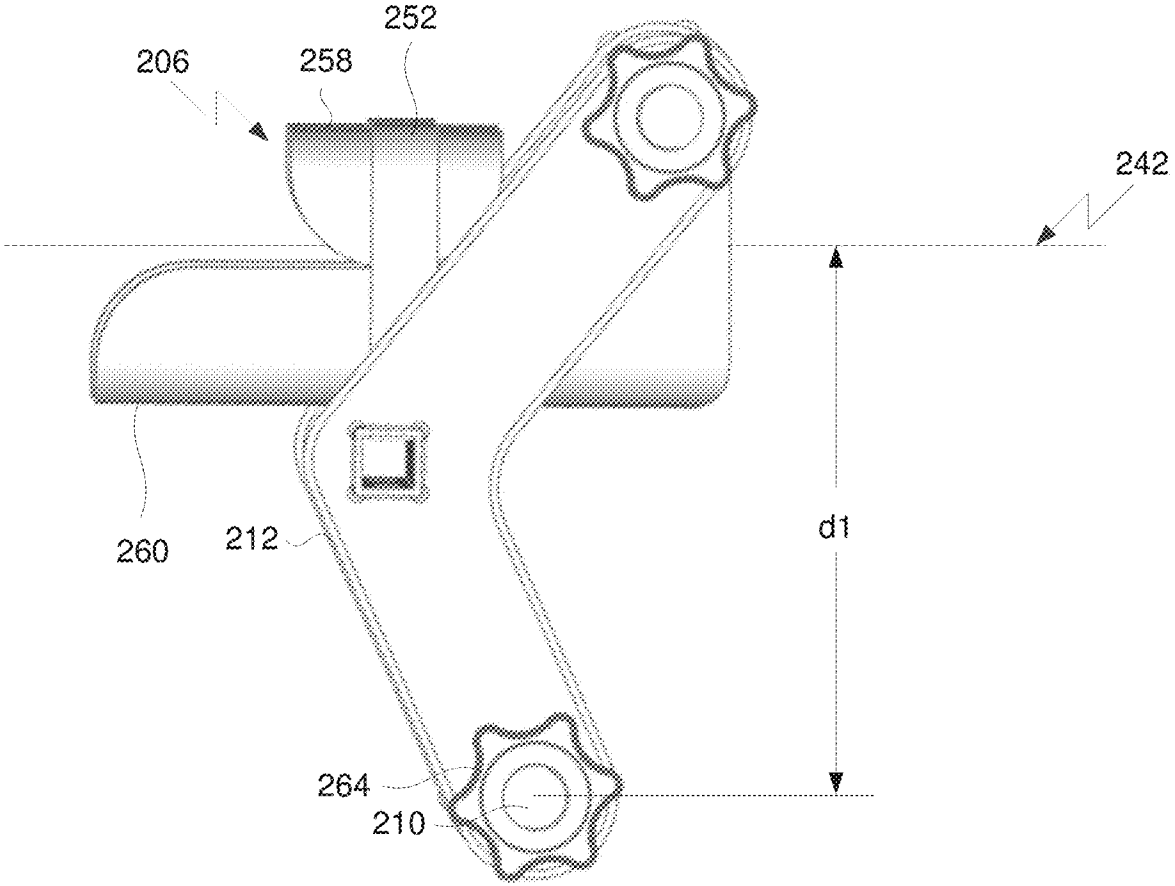
FIG. 17 is a right side view of the resistance training exercise device of FIG. 10.

The second holder 206 is spaced apart from the first holder 204 and disposed on the holder support 218 proximate the second side member 214. The second holder 206 defines a second lever channel axis 242 (FIG. 17). The second holder 206 has a first end 244 (FIG. 11) for receiving the right forearm of the user of the exercise device 200, and a second end 246 (FIG. 10) opposing the first end 244. The second holder 206 is shaped and dimensioned to surround the right forearm of the user.

The exercise device 200 also includes a handle 248. The handle 248 is also coupled to the first side member 212 at the top end 232 of the first side member 212 and coupled to the second side member 214 at the top end 234 of the second side member 214. The handle 248 extends from first side member 212, through apertures in the first holder 204 and the second holder 206, and to the second side member 214, as described in further detail below. In other examples, the handle 248 may be provide as two distinct components, and need not extend entirely between the first and second side members 212 and 214. In further examples, the handle 248 may simply be omitted.

The first weight support 208 is coupled to the first side member 212 at the bottom end 228 of the first side member 212. The first weight support 208 is spaced apart from the holder support 218. The first weight support 208 extends from the first side member 212 in a direction away from the space between the first and second side members 212 and 214. The first weight support 208 is configured to receive one or more weights thereon.

The second weight support 210 is coupled to the second side member 214 at the bottom end 230 of the second side member 214. The second weight support 210 extends substantially perpendicular to the second side member 214 in a direction away from the space between the first and second side members 212 and 214. The second weight support 210 is configured to receive one or more weights thereon. The first and second weight supports 208 and 210 may be integrally formed with the cross bar 216 (i.e. the ends of the cross bar 216 may extend through the bottom ends of the first and second side members 212 and 214 to form the first and second weight supports 208 and 210). In other examples, however, the first and second weight supports 208 and 210 may be discrete components from the cross bar 216.

In the embodiment shown in FIG. 10 to FIG. 17, the first weight support 208 is substantially perpendicular to the first side member 212 to inhibit the one or more weights from sliding off the first weight support 208 when the one or more weights are placed on the first weight support 208. Also, the second weight support 210 is substantially perpendicular to the second side member 214 to inhibit the one or more weights from sliding off the second weight support 210 when the one or more weights are placed on the second weight support 210. However, in alternative embodiments, one or both of the first weight support 208 and the second weight support 210 can be connected to the first and second side members 212 and 214 at non-right angles.

A first bracket 250 surrounds the first holder 204 and is affixed to the holder support 218 by fasteners, such as for example, a bolt and a nut. A second bracket 252 surrounds the second holder 206 and is affixed to the holder support 218 by a fastener, such as for example, a bolt and a nut.

Figure 15:
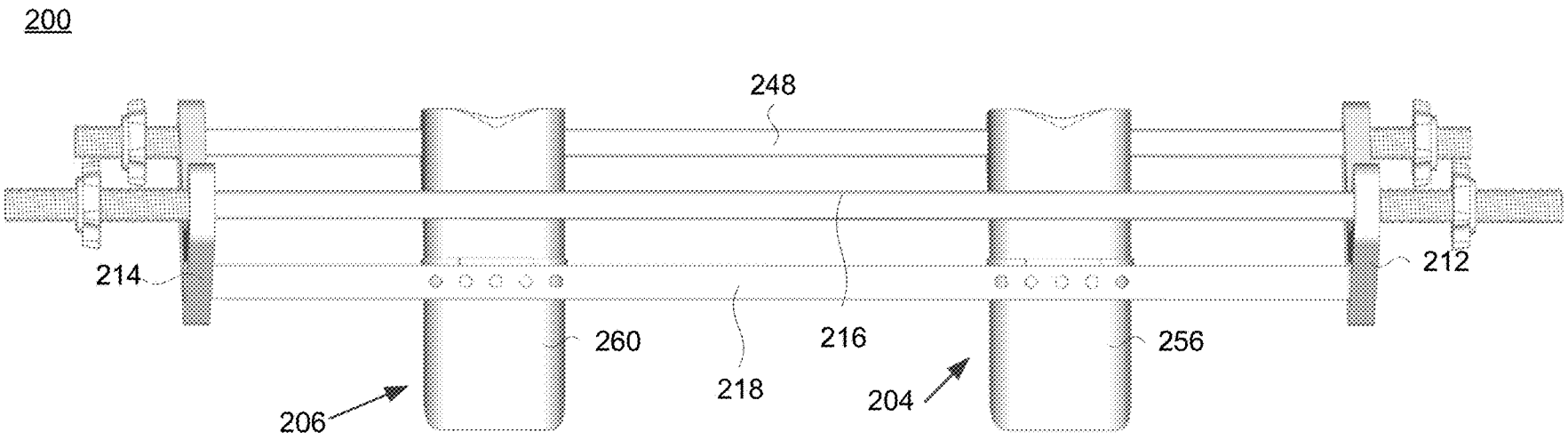
FIG. 15 is a bottom view of the resistance training exercise device of FIG. 10.

Also, in the embodiment shown in FIG. 10 to FIG. 17, the first holder 204 includes two separate parts, an upper forearm support 254 (FIG. 14) and a lower forearm support 256 (FIG. 15). The upper forearm support 254 may include padding for cushioning the ventral side of the left forearm of the user, and the lower forearm support 256 may include padding for cushioning the dorsal side of the left forearm. It will be appreciated that in other alternative embodiments, the padding may be omitted from the upper forearm support 254 and/or lower forearm support 256 of the first holder 204.

The second holder 206 also includes two separate parts, an upper forearm support 258 (FIG. 14) and a lower forearm support 260 (FIG. 15). The upper forearm support 258 may include padding for cushioning the ventral side of the right forearm of the user, and the lower forearm support 260 may include padding for cushioning the dorsal side of the right forearm of the user. It will be appreciated that in other alternative embodiments, the padding may be omitted from the upper forearm support 258 and/or lower forearm support 260 of the second holder 206.

Although in the embodiment shown in FIG. 10 to FIG. 17, the first holder 204 and the second holder 206 each include two separate parts, in alternative embodiments, the first holder 204 may be a single part shaped and dimensioned to receive, surround, and retain the left forearm of the user therein. Also, in other alternative embodiments, the second holder 206 may be a single part shaped and dimensioned to receive and surround the right forearm of the user therein.

Also, in the embodiment shown in FIG. 10 to FIG. 17, the handle 248 passes through apertures in the lower forearm support 256 of the first holder 204 and the lower forearm support 260 of the second holder 206. In alternative embodiments, the handle 248 may simply extend in front of the first holder 204 and the second holder 206 such that the hands of a user may grip the handle 248 when the left forearm of the user is placed within the first holder 204 and the right forearm of the user is placed within the second holder 206.

Also, in the embodiment shown in FIG. 10 to FIG. 17, both the first weight support 208 and the second weight support 210 are threaded. The exercise device 200 may include a first collar 262 (e.g. FIG. 16) for securing one or more weights to the first weight support 208 and for inhibiting the one or more weights from falling off the first weight support 208. The exercise device 200 may also include a second collar 264 (e.g. FIG. 17) for securing one or more weights to the second weight support 210 and for inhibiting the one or more weights from falling off the second weight support 210. It will be appreciated that in alternative embodiments, the first weight support 208 and/or the second weight support 210 may not be threaded. In these alternative embodiments, any suitable clamp, collar, or lock jaw may be used to secure one or weights onto the first weight support 208 and/or the second weight support 210 and to the one or more weights from sliding or falling off the first weight support 208 and/or the second weight support 210.

It will also be appreciated that in other alternative embodiments, the cross bar 216 may be omitted, the first weight support 208 may be coupled to and extend from the first side member 212 in a direction towards the inner surface 224 of the second side member 214, and the second weight support 210 may be coupled to and extend from the second side member 214 in a direction toward the inner surface 220 of the first side member 212.

It will also be appreciated that although in the embodiment shown in FIG. 10 to FIG. 17, the first weight support 208, the cross bar 216, and the second weight support 210 are separate pieces, in alternative embodiments, the first weight support 208, the cross bar 216 and the second weight support 210 may be a single integral piece that extends through the first side member 212 and the second side member 214.

The operation of exercise device 100 will now be described with reference to FIGS. 18A, 18B, and 18C which show the exercise device 200, from the left side of the user, being used to perform a biceps curl with the use of a preacher curl bench 1800. The exercise device 200 is shown positioned for use, with the left forearm of the user extending through the channel defined by the first holder 204 and the user's left hand gripping the handle 248. As will be apparent, the user's right arm, although not shown, extends through the second holder 206 and the user's right hand grasps the second handle 160, a weight 1802 is supported by the first weight support 208 and maintained on the first weight support 208 by the first collar 262. As will be apparent, the forearms of the user rotate about the elbows of the user, primarily through the action of the biceps and triceps. The left elbow of the user is indicated as a pivot point 1804, through which the first lever channel axis 236 passes.

Figure 18A:
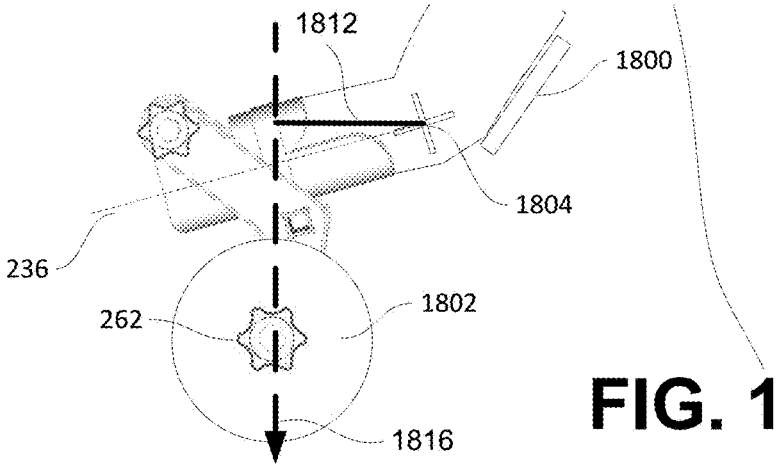
FIGS. 18A-18C are side views of the resistance training exercise device of FIG. 10 travelling from an extended position to a contracted position during use.
Figure 18B:
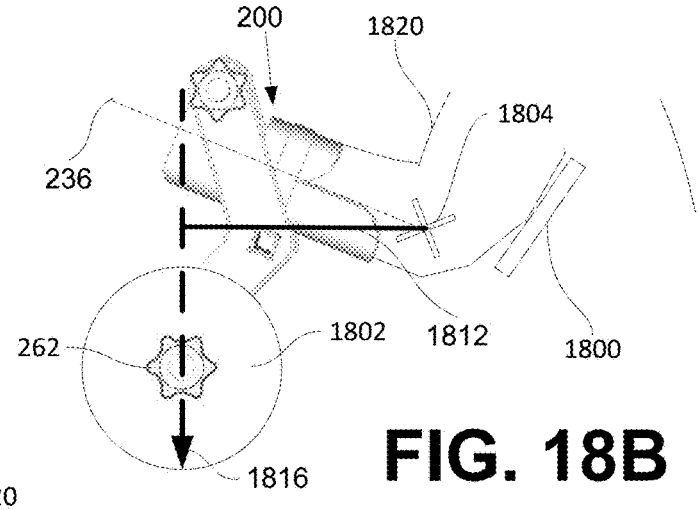
Figure 18C:
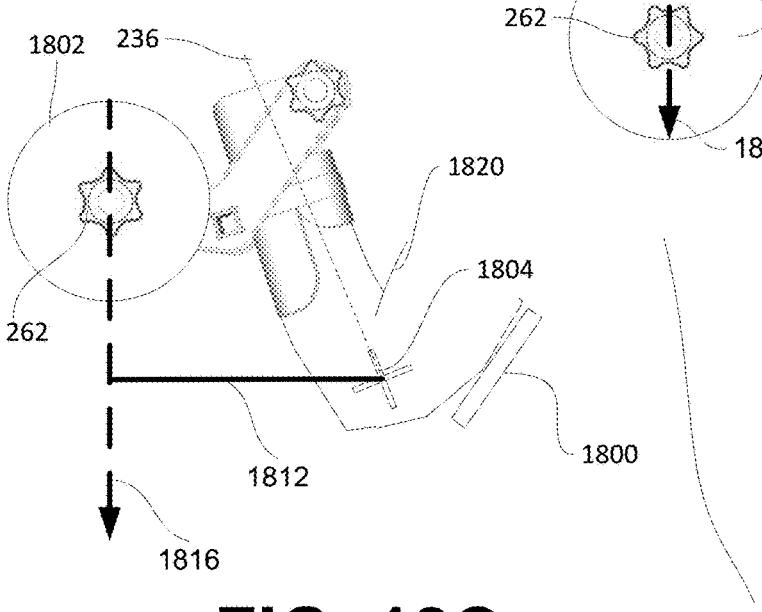

The biceps curl performed with the exercise device 200 requires the user to contract the biceps to rotate the exercise device 200 in the direction indicated at 1808 (clockwise, in the illustration of FIGS. 18A to 18C), from an extended position shown in FIG. 18A to a contracted position shown in FIG. 18C. The extended position is referred to as extended because in FIG. 18A, the muscles under load (the biceps, in this example) are substantially fully extended. Conversely, the contracted position is referred to as contracted because in FIG. 18C, the muscles under load are substantially fully contracted.

As will now be apparent, the load imposed on the biceps by the weight 1802 varies with the length of a moment arm 1812 measured perpendicularly to the vertical (i.e. toward the earth) line of action 1816 of the weight 1802 to the pivot point 1804. As seen in FIGS. 18A-18C, due to the spacing of the weight 1802 relative to the first lever channel axis 236, the moment arm 1812 is substantially at a minimum in the extended position. Further the moment arm 1812 grows through the exercise, substantially reaching a maximum as the biceps reach full contraction in FIG. 18C.

Certain structural features of the exercise device 200 permit the above-mentioned synchronization of increasing load with increasing contraction of the muscle. In particular, as shown in FIGS. 18A-18C, the positioning of the first weight support 208 relative to the first lever channel axis 236 places the first weight support 208 at a greater angle relative to the upper arm 1820 (measured from the bicep side of the upper arm 1820) of the user than the first lever channel axis 236. In FIG. 18A, for example, the above-mentioned angle between the upper arm 1820 and the first lever channel axis 236 is about 140 degrees, whereas the angle between the upper arm 1820 and the first weight support 208 is about 180 degrees. Turning to FIG. 18B, the angle between the upper arm 1820 and the first lever channel axis 236 is about 90 degrees, while the angle between the upper arm 1820 and the first weight support 208 is about 130 degrees. Finally, in FIG. 18C the angle between the upper arm 1820 and the first lever channel axis 236 is about 30 degrees, while the angle between the upper arm 920 and the first weight support 108 is about 70 degrees. As will also be apparent, the difference between the above-mentioned angles remains constant throughout the range of motion of the exercise device 200 (a difference of about 40 degrees, in the illustrated examples). For the biceps curl illustrated in FIGS. 18A-18C, the structure of the exercise device 200 causes the weight 1802 to lag behind the forearm of the user through the contraction of the biceps.

The synchronization between increasing load and increasing contraction noted above may reduce the likelihood of injury during the exercise, and may also increase the effectiveness of the exercise.

The exercise devices 100 and 200 can be utilized to exercise the triceps and biceps, respectively, of both arms of a user simultaneously. It will be appreciated, how exercise n alternative embodiments, the exercise devices 100 and 200 can be implemented for single-arm exercises. For example, with respect to the exercise device 100, the cross bar 116 can be omitted. In this alternative embodiment, the first side member 112 can extend between the first holder support 118 and the first arm 122, and the second side member 114 can extend between the second holder support 120 and the second arm 124 to provide two individual rotary resistance training exercise devices that can be used to perform triceps curls individually.

The exercise devices described herein enable a user to perform rotary resistance training exercises, such as triceps curls and biceps curls, in which the load applied by the weights is substantially in phase with the degree of contraction of the muscle under load. Further, the exercise devices described herein may reduce stress on the hands, wrists and elbows of a user when the user is performing a rotary resistance exercise, thereby reducing the likelihood of the user stopping performing the resistance training exercise due to fatigue in the hands, wrists and elbows.

The described embodiments are to be considered in all respects only as illustrative and not restrictive. The scope of the claims should not be limited by the preferred embodiments set forth in the examples, but should be given the broadest interpretation consistent with the description as a whole. All changes that come with meaning and range of equivalency of the claims are to be embraced within their scope.

What is claimed is:

1. A resistance training exercise device comprising:

a frame including:

a pair of spaced apart side members; and a holder support coupled to each of the side members and extending between the pair of side members;

a first holder and a second holder disposed on the holder support between the pair of side members, wherein each holder comprises: an upper forearm support for supporting a top of the forearm of the user; a lower forearm support for supporting a bottom of the forearm of the user; and, a bracket surrounding the upper forearm support and the lower forearm support, the first and second holders each defining respective lever channels having axes spaced apart from the holder support in a first direction, each lever channel for receiving a respective forearm of a user, the holders and the frame configured to rotate with the forearms about respective elbows relative to corresponding upper arms when the user is performing a rotary resistance training exercise; and a first weight support for receiving one or more weights thereon, the weight support fixed to a first one of the side members of the frame and spaced apart from the holders in a second direction opposite to the first direction; and a second weight support for receiving one or more weights thereon, the weight support fixed to a second one of the side members of the frame and spaced apart from the holders in the second direction.

2. The resistance training exercise device of claim 1, wherein the first and second holders and the frame are configured to rotate with the forearms about the elbows of the user relative to the upper arms of the user between a first position in which the holders are substantially 90 degrees to the upper arms and a second position in which the holders are substantially 180 degrees to the upper arms, wherein the weight supports lag the lever channels when rotating the holders from the second position to the first position.

3. The resistance training exercise device of claim 1, further comprising a handle coupled between the side members for gripping by the user when the forearms of the user are placed within the holders.

4. The resistance training exercise device of claim 1, wherein the first weight support is fixed to the first side member, and the second weight support is fixed to the second side member.

5. The resistance training exercise device of claim 4, wherein the first weight support extends away from an outer surface of the first side member, and the second weight support extends away from an outer surface of the second side member.

* * * * *